US007776191B2

(12) United States Patent
Hiltmann et al.

(10) Patent No.: US 7,776,191 B2
(45) Date of Patent: Aug. 17, 2010

(54) CATHHODES FOR ALUMINUM ELECTROLYSIS CELL WITH NON-PLANAR SLOT CONFIGURATION

(75) Inventors: Frank Hiltmann, Kriftel (DE); Philippe Beghein, Passy (FR)

(73) Assignee: SGL Carbon SE, Wiesbaden (DE)

( * ) Notice: Subject to any disclaimer, the term of this patent is extended or adjusted under 35 U.S.C. 154(b) by 0 days.

(21) Appl. No.: 12/250,743

(22) Filed: Oct. 14, 2008

(65) Prior Publication Data

US 2009/0050474 A1 Feb. 26, 2009

Related U.S. Application Data

(63) Continuation of application No. PCT/EP2006/012334, filed on Dec. 20, 2006.

(30) Foreign Application Priority Data

Apr. 13, 2006 (EP) ..... 06007808

(51) Int. Cl.
*C25B 11/12* (2006.01)
*C25B 9/04* (2006.01)
*C25C 3/08* (2006.01)

(52) U.S. Cl. ..... 204/294; 204/280; 204/243.1; 204/247.4; 204/247.5; 204/286.1; 29/825; 29/745; 29/746

(58) Field of Classification Search ..... 204/243.1, 204/247.4, 243.5, 280, 286.1, 294; 29/745, 29/746, 825
See application file for complete search history.

(56) References Cited

U.S. PATENT DOCUMENTS 4,110,179 A 8/1978 Tschopp
4,194,959 A * 3/1980 Hudson et al. ..... 204/243.1
4,795,540 A 1/1989 Townsend
6,294,067 B1 * 9/2001 Gauthier et al. ..... 205/372

FOREIGN PATENT DOCUMENTS

RU 2060303 C1 5/1996

OTHER PUBLICATIONS

International Search Report, dated Oct. 4, 2007.
International Search Report dated Oct. 4, 2007.

* cited by examiner

*Primary Examiner*—Bruce F Bell
(74) *Attorney, Agent, or Firm*—Laurence A. Greenberg; Werner H. Stemer; Ralph E. Locher

(57) ABSTRACT

Cathodes for aluminum electrolysis cells are formed of cathode blocks and current collector bars attached to those blocks. The cathode block has a cathode slot for receiving the collector bar and has a higher depth at a center than at both lateral edges of the cathode block. Additionally, the collector bar thickness is higher at the center than at both lateral edges of the cathode block. This cathode configuration provides a more even current distribution and, thus, a longer useful lifetime of such cathodes and increases cell productivity.

15 Claims, 8 Drawing Sheets

CATHHODES FOR ALUMINUM ELECTROLYSIS CELL WITH NON-PLANAR SLOT CONFIGURATION

CROSS-REFERENCE TO RELATED APPLICATIONS

This is a continuation, under 35 U.S.C. §120, of copending international application No. PCT/EP2006/012334, filed Dec. 20, 2006, which designated the United States; this application also claims the priority, under 35 U.S.C. §119, of European patent application No. EP 06007808.6, filed Apr. 13, 2006; the prior applications are herewith incorporated by reference in their entirety.

BACKGROUND OF THE INVENTION

Field of the Invention

The invention relates to cathodes for aluminum electrolysis cells containing cathode blocks and current collector bars attached to those blocks. Cathode slots are formed for receiving the collector bar and have a non-planar configuration. Further, the collector bar configuration is adapted to such a non-planar slot configuration. As a result, a more uniform current distribution along the cathode length is achieved. This provides a longer useful life time of such cathodes by reduced cathode wear and thus increased cell productivity.

Aluminum is conventionally produced by the Hall-Heroult process, by the electrolysis of alumina dissolved in cryolite-based molten electrolytes at temperatures up to around 970° C. A Hall-Heroult reduction cell typically has a steel shell provided with an insulating lining of refractory material, which in turn has a lining of carbon contacting the molten constituents. Steel-made collector bars connected to the negative pole of a direct current source are embedded in the carbon cathode substrate forming a cell bottom floor. In the conventional cell configuration, steel cathode collector bars extend from the external bus bars through each side of the electrolytic cell into the carbon cathode blocks.

Each cathode block has at its lower surface one or two slots or grooves extending between opposed lateral ends of the block to receive the steel collector bars. Those slots are machined typically in a rectangular shape. In close proximity to the electrolysis cell, these collector bars are positioned in the slots and are attached to the cathode blocks most commonly with cast iron (called "rodding") to facilitate electrical contact between the carbon cathode blocks and the steel. The thus prepared carbon or graphite made cathode blocks are assembled in the bottom of the cell by using heavy equipment such as cranes and finally joined with a ramming mixture of anthracite, graphite, and coal tar to form the cell bottom floor. A cathode block slot may house one single collector bar or two collector bars facing each other at the cathode block center coinciding with the cell center. In the latter case, the gap between the collector bars is filled by a crushable material or by a piece of carbon or by tamped seam mix or preferably by a mixture of such materials.

Hall-Heroult aluminum reduction cells are operated at low voltages (e.g. 4-5 V) and high electrical currents (e.g. 100,000-400,000 A). The high electrical current enters the reduction cell from the top through the anode structure and then passes through the cryolite bath, through a molten aluminum metal pad, enters the carbon cathode block, and then is carried out of the cell by the collector bars.

The flow of electrical current through the aluminum pad and the cathode follows the path of least resistance. The electrical resistance in a conventional cathode collector bar is proportional to the length of the current path from the point the electric current enters the cathode collector bar to the nearest external bus. The lower resistance of the current path starting at points on the cathode collector bar closer to the external bus causes the flow of current within the molten aluminum pad and carbon cathode blocks to be skewed in that direction. The horizontal components of the flow of electric current interact with the vertical component of the magnetic field in the cell, adversely affecting efficient cell operation.

The high temperature and aggressive chemical nature of the electrolyte combine to create a harsh operating environment. Hence, existing Hall-Heroult cell cathode collector bar technology is limited to rolled or cast mild steel sections. In comparison, potential metallic alternatives such as copper or silver have high electrical conductivity but low melting points and high cost.

Until some years ago, the high melting point and low cost of steel offset its relatively poor electrical conductivity. The electrical conductivity of steel is so poor relative to the aluminum metal pad that the outer third of the collector bar, nearest the side of the pot, carries the majority of the load, thereby creating a very uneven cathode current distribution within each cathode block. Because of the chemical properties, physical properties, and, in particular, the electrical properties of conventional cathode blocks based on anthracite, the poor electrical conductivity of steel had not presented a severe process limitation until recently. In view of the relatively poor conductivity of the steel bars, the same rationale is applicable with respect to the relatively high contact resistance between cathode and cast iron that has so far not played a predominant role in cell efficiency improvement efforts. However, with the general trend towards higher energy costs, this effect becomes a non-negligible factor for smelting efficiency.

Ever since, aluminum electrolysis cells have increased in size as the operating amperage has increased in pursuit of economies of scale. As the operating amperage has been increased, graphite cathode blocks based on coke instead of anthracite have become common and further the percentage of graphite in cathodes has increased to take advantage of improved electrical properties and maximize production rates. In many cases, this has resulted in a move to partially or fully graphitized cathode blocks. Graphitization of carbon blocks occurs in a wide temperature range starting at around 2000° C. stretching up to 3000° C. or even beyond. The terms "partially graphitized" or "fully graphitized" cathode relate to the degree of order within the domains of the carbon crystal structure. However, no distinct border line can be drawn between those states. Principally, the degree of crystallization or graphitization, respectively, increases with maximum temperature as well as treatment time at the heating process of the carbon blocks. For the description of our invention, we summarize those terms using the terms "graphite" or "graphite cathode" for any cathode blocks at temperatures above around 2000° C. In turn, the terms "carbon" or "carbon cathode" are used for cathode blocks that have been heated to temperatures below 2000° C.

Triggered by the utilization of carbon and graphite cathodes providing higher electrical conductivities, increasing attention had to be paid to some technical effects that were so far not in focus: wear of cathode blocks, uneven current distribution and energy loss at the interface between cathode block and cast iron.

All three effects are somewhat interlinked and any technical remedy should ideally address more than one single item of this triade.

The wear of the cathode blocks is mainly driven by mechanical erosion by metal pad turbulence, electrochemical carbon-consuming reactions facilitated by the high electrical currents, penetration of electrolyte and liquid aluminum, as well as intercalation of sodium, which causes swelling and deformation of the cathode blocks and ramming mixture. Due to resulting cracks in the cathode blocks, bath components migrate towards the steel cathode conductor bars and form deposits on the cast iron sealant surface leading to deterioration of the electrical contact and non-uniformity in current distribution. If liquid aluminum reaches the iron surface, corrosion via alloying immediately occurs and an excessive iron content in the aluminum metal is produced, forcing a premature shut-down of the entire cell.

Cathode block erosion does not occur evenly across the block length. Especially in the application of graphite cathode blocks, the dominant failure mode is due to highly localized erosion of the cathode block surface near its lateral ends, shaping the surface into a W-profile and eventually exposing the collector bar to the aluminum metal. In a number of cell configurations, higher peak erosion rates have been observed for these higher graphite content blocks than for conventional carbon cathode blocks. Erosion in graphite cathodes may even progress at a rate of up to 60 mm per annum. Operating performance is therefore traded for operating life.

There is a link between the rapid wear rate, the location of the area of maximum wear, and the non-uniformity of the cathode current distribution. Graphite cathodes are more electrically conductive and as a result have a much more non-uniform cathode current distribution pattern and hence suffer from higher wear.

In U.S. Pat. No. 2,786,024 (Wleügel) it is proposed to overcome non-uniform cathode current distribution by utilizing collector bars which are bent downward from the cell center so that the thickness of the cathode block between the collector bar and the molten metal pad increases from the cell center towards the lateral edges. This proposal would have required not only curved components but also a significantly modified entire cell design being adapted. These requirements prevented this approach to become used in practice.

U.S. Pat. No. 4,110,179 (Tschopp) describes an aluminum electrolysis cell with uniform electric current density across the entire cell width. This is achieved by gradually decreasing the thickness of the cast iron layer between the carbon cathode blocks and the embedded collector bars towards the edge of the cell. In a further embodiment of that invention, the cast iron layer is segmented by non-conductive gaps with increasing size towards the cell edge. In practice however, it appeared too cumbersome and costly to incorporate such modified cast iron layers.

In U.S. Pat. No. 6,387,237 (Homley et al.) an aluminum electrolysis cell with uniform electric current density is claimed containing collector bars with copper inserts located in the area next to the cell center thus providing higher electrical conductivity in the cell center region. Again, this method did not find application in aluminum electrolysis cells due to added technical and operational complexities and costs in implementing the described solution.

Neither prior art approach considered the use of cathode blocks with standard external dimensions having a modified slot configuration and collector bars adapted to such a modified slot.

SUMMARY OF THE INVENTION

It is accordingly an object of the invention to provide cathodes for aluminum electrolysis cell with a non-planar slot configuration that overcome the above-mentioned disadvantages of the prior art methods and devices of this general type. Accordingly, in order to fully realize the operating benefits of carbon and graphite cathode blocks without any trade-offs with regards to existing operational procedures and standard cell configurations there is a need for decreasing cathode wear rates and increasing cell life by providing a more uniform cathode current distribution and at the same time providing cathodes with standard external dimensions.

With the foregoing and other objects in view there is provided, in accordance with the invention, a cathode for aluminum electrolysis cells. The cathode contains at least one steel-made current collector bar; and a cathode block selected from the group consisting of a carbon cathode block and a graphite cathode block. The cathode block has a collector bar slot formed therein and receives the steel-made current collector bar. The collector bar slot has a depth higher at a center than at both lateral edges of the cathode block.

It is therefore an object of the present invention to provide carbon or graphite cathode blocks with standard external dimensions with collector bar slots, characterized in that the slot depth is increasing towards the cathode block center. In cathodes containing such cathode blocks and standard steel collector bars, the electrical field lines, i.e. the electrical current, are drawn away from the lateral block edges towards the block center thus providing a more uniform current distribution along the cathode block length.

It is another object of the present invention to provide a cathode containing a carbon or graphite cathode block with standard external dimensions with collector bar slots with increasing depth towards the cathode block center and attached current collector bars, characterized in that the current collector bar thickness is increasing towards the block center at a side facing the slot top face. In the respective cathodes, the electrical field lines, i.e. the electrical current, are drawn away from the lateral block edges towards the block center even more remarkably than in the case of alone changing the slot configuration. Hence, this embodiment provides a considerable improvement in uniform current distribution along the cathode block length.

It is another object of this invention to provide a method of manufacturing cathodes for aluminum electrolysis cells by manufacturing a carbon or graphite cathode block and attaching a steel collector bar to such lined block.

Other features which are considered as characteristic for the invention are set forth in the appended claims.

Although the invention is illustrated and described herein as embodied in cathodes for aluminum electrolysis cell with non-planar slot configuration, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
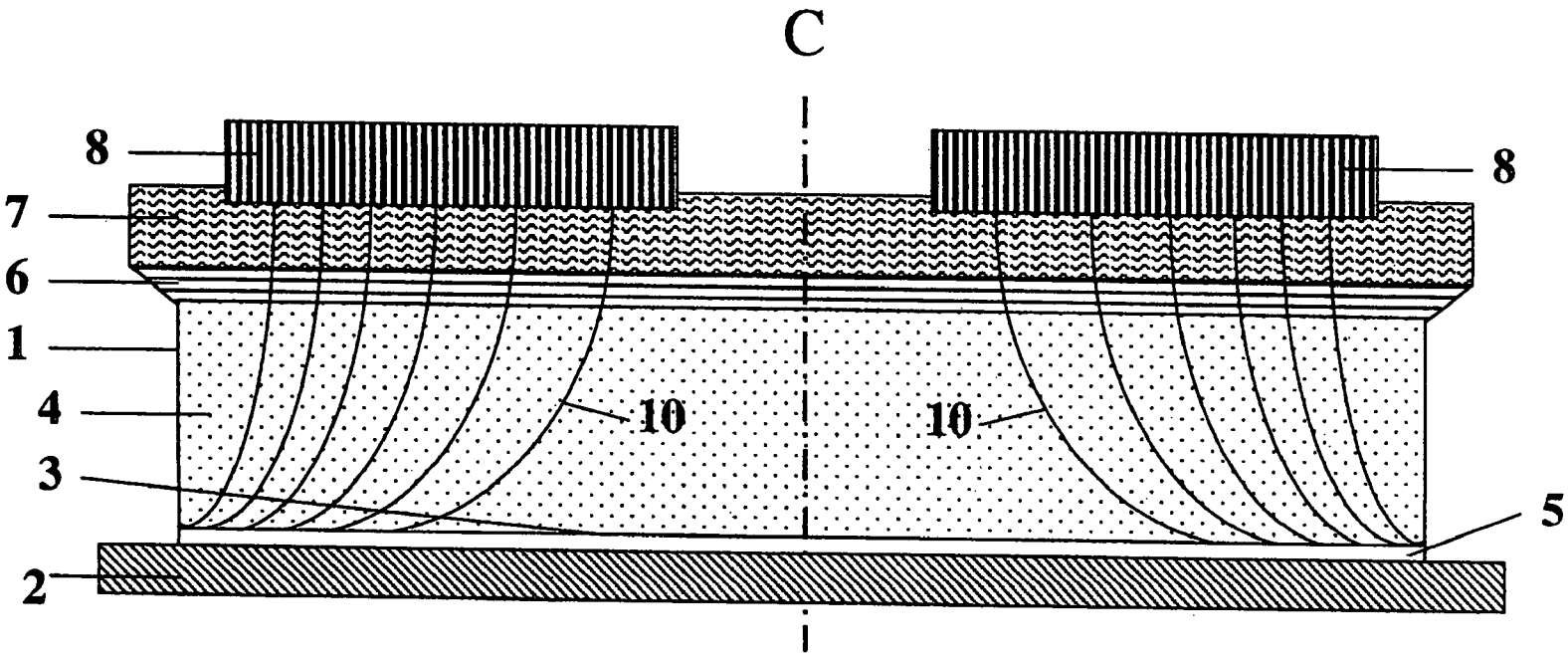
FIG. 1 PRIOR ART
FIG. 1 is a diagrammatic, cross-sectional view of a prior art electrolytic cell for aluminum production showing the cathode current distribution.

Referring now to the figures of the drawing in detail and first, particularly, to FIG. 1 thereof, there is shown a cross-cut of an electrolytic cell for aluminum production, having a prior art cathode 1. The collector bar 2 has a rectangular transverse cross-section and is fabricated from mild steel. It is embedded in the collector bar slot 3 of the cathode block 4 and connected to it by cast iron 5. The cathode block 4 is made of carbon or graphite by methods well known to those skilled in the art.

Not shown are the cell steel shell and the steel-made hood defining the cell reaction chamber lined on its bottom and sides with refractory bricks. The cathode block 4 is in direct contact with a molten aluminum metal pad 6 that is covered by the molten electrolyte bath 7. Electrical current enters the cell through anodes 8, passes through the electrolytic bath 7 and the molten metal pad 6, and then enters the cathode block 4. The current is carried out of the cell via the cast iron 5 by the cathode collector bars 2 extending from bus bars outside the cell wall. The cell is build symmetrically, as indicated by a cell center line C.

As shown in FIG. 1, electrical current lines 10 in a prior art electrolytic cell are non-uniformly distributed and concentrated more toward ends of the collector bar at the lateral cathode edge. The lowest current distribution is found in the middle of the cathode 1. Localized wear patterns observed on the cathode block 4 are deepest in the area of highest electrical current density. This non-uniform current distribution is the major cause for the erosion progressing from the surface of a cathode block 4 until it reaches the collector bar 2. That erosion pattern typically results in a "W-shape" of the cathode block 4 surface.

Figure 2:
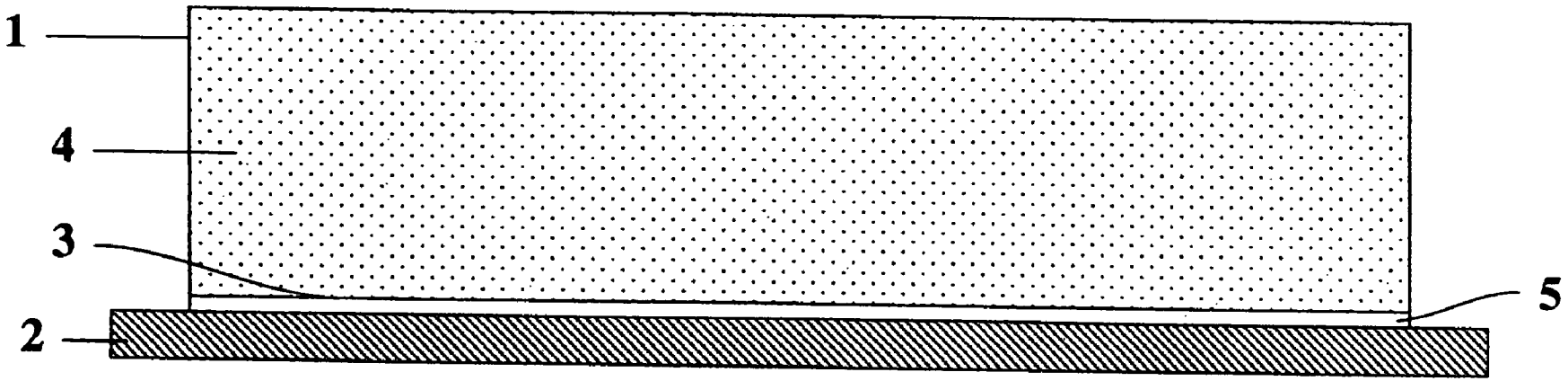
FIG. 2 PRIOR ART
FIG. 2 is a diagrammatic, side view of a prior art cathode.

FIG. 2 depicts a prior art cathode 1. The collector bar 2 has a rectangular transverse cross-section and is fabricated from mild steel. It is embedded in the collector bar slot 3 of the carbon or graphite cathode block 4 and connected to it by cast iron 5. The prior art slot 3 has a planar top face and a depth ranging between 100 mm to 200 mm. The side faces of the slot 3 may be planar or slightly concave (dovetail shape). Although the steel collector bar 2 is secured to such block typically by cast iron 5, ramming paste or high-temperature glue are also appropriate for securing the collector bar 2 to the cathode block 4.

Figure 3:
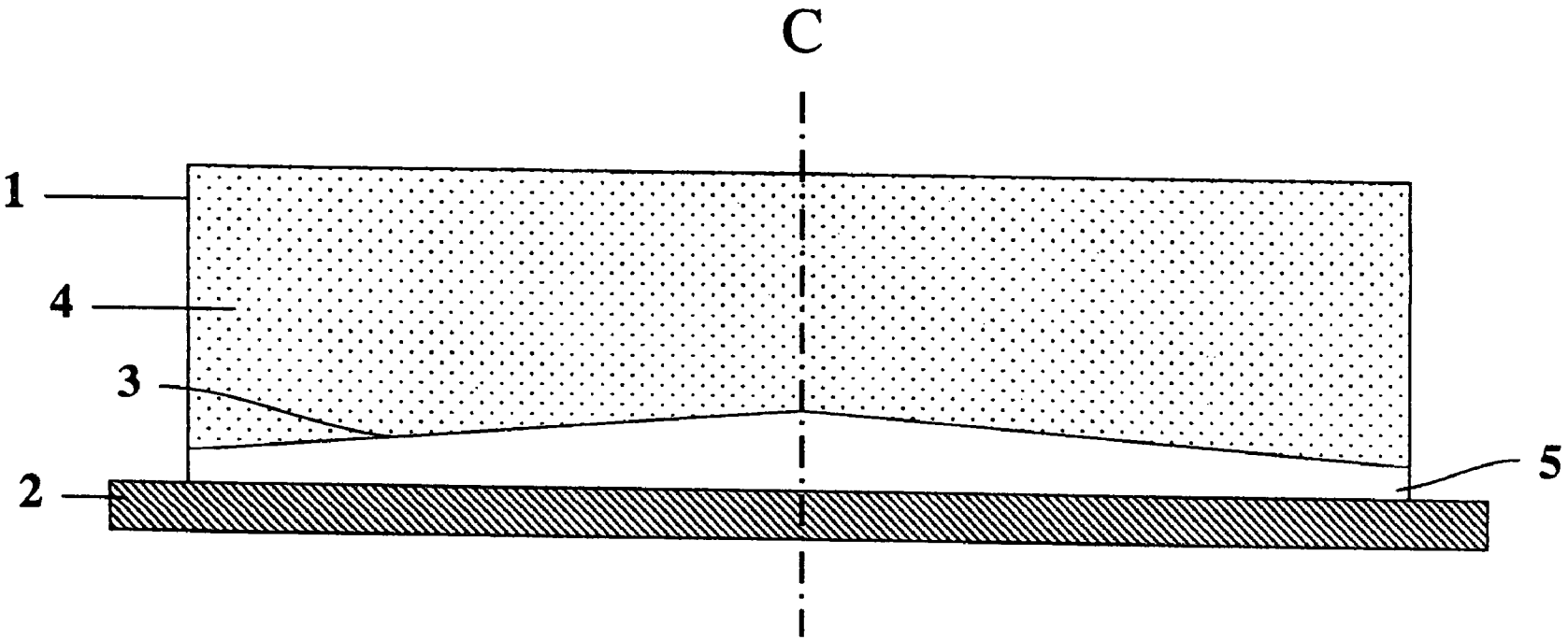
FIG. 3 is a diagrammatic, side view of a cathode according to the invention.

FIG. 3 depicts the cathode 1 according to the invention. The prior art collector bar 2 has a rectangular transverse cross-section and is fabricated from mild steel. It is embedded in the collector bar slot 3 of the carbon or graphite cathode block 4 and connected to it by cast iron 5. The slot 3 does not have a planar top face but its depth is increasing towards its center C. The depth of slot 3 at the block center C can range between 10 to 60 mm in relation to the slot 3 depth at the lateral block edges. Taking the slot 3 depth at the lateral block edges of 100 mm to 200 mm into account, the overall depth of slot 3 at the block center C can range between 110 to 260 mm.

Figure 4A:
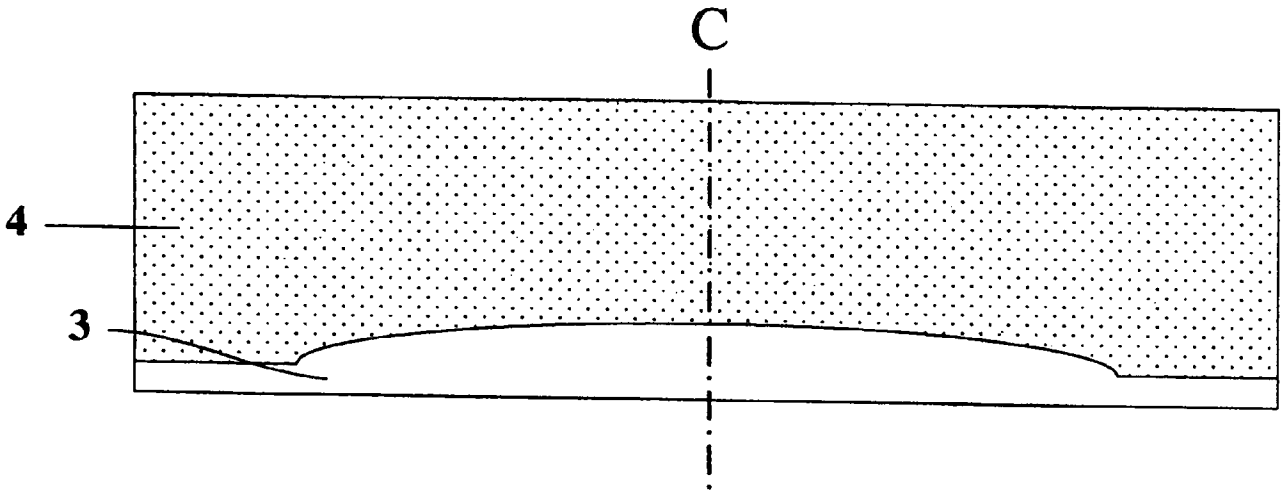
FIGS. 4A and 4B are diagrammatic, side views of two embodiments of a cathode block for a cathode according to the invention.
Figure 4B:
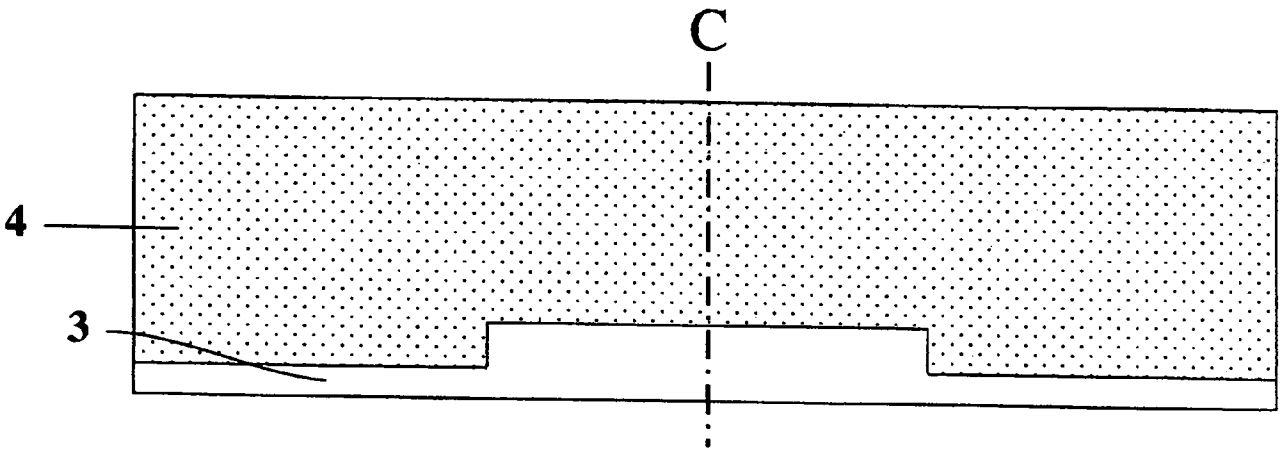

As shown in FIG. 4A and FIG. 4B the slot 3 may also have e.g. a semi-circular or semi-ellipsoidal shape and the shape may comprise one or more steps.

Also shown in FIG. 4A and FIG. B is that non-planarity of the top face of the slot 3 may not necessarily start directly from lateral block edges but the slot 3 may have an initial planar top face at both lateral block edges stretching over 10 to 1,000 mm from each edge.

The slot 3 according to this invention is machined into the cathode block 4 using the standard manufacturing equipment and procedures as used for prior art slots 3.

In cathodes 1 containing such inventive cathode blocks 4 and prior art steel collector bars 2, the electrical field lines 10, i.e. the electrical current, are drawn away from the lateral block edges towards the block center C thus providing a more uniform current distribution along the cathode block 4 length.

Figure 5:
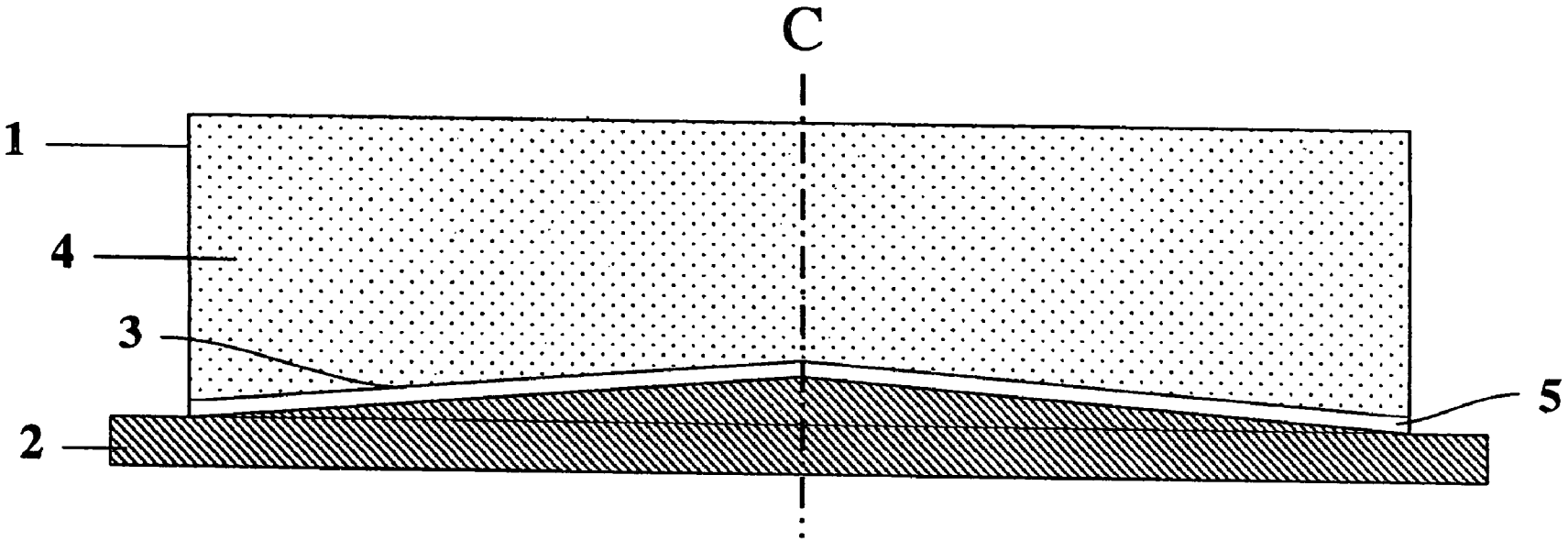
FIG. 5 is a diagrammatic, side view of a cathode according to the invention.

FIG. 5 depicts a cathode 1 according to the invention. The cathode block 4 has a non-planar collector bar slot 3 according to the invention, as shown in FIG. 3. The steel collector bar 2 has a triangular shape fitting to the configuration of slot 3. The thickness of collector bar 2 is increasing at the face facing the slot 3 top face towards its center C.

Although depicted in triangular shape, the collector bar 2 may also have e.g. a semi-circular or semi-ellipsoidal shape. The shape may comprise one or more steps.

In cathodes 1 containing inventive cathode blocks 4 as well as inventive steel collector bars 2, the electrical field lines 10, i.e. the electrical current, are drawn away from the lateral block edges towards the block center C thus providing a more uniform current distribution along the cathode block 4 length.

Figure 6:
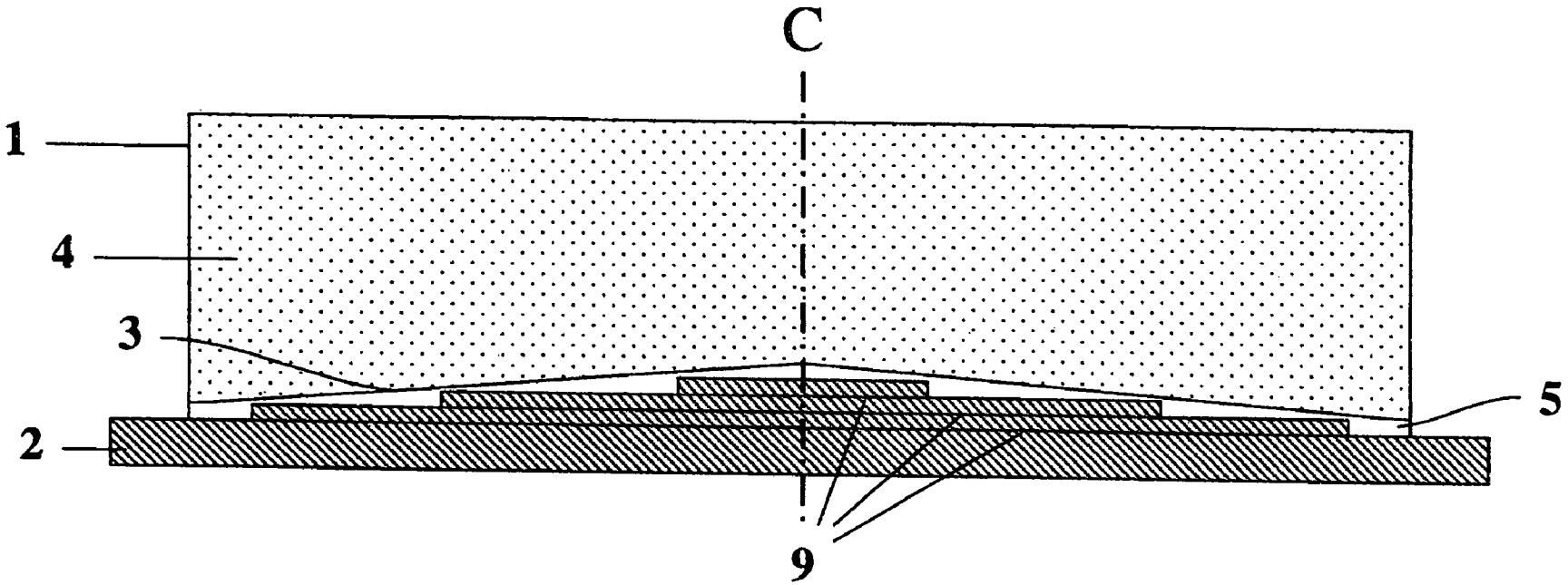
FIG. 6 is a diagrammatic, side view of a cathode according to the invention.

FIG. 6 depicts one embodiment of the cathode 1 according to the invention, as described in FIG. 5. In this embodiment, the steel collector bar 2 does not consist of one single piece but is contains a prior art planar collector bar 2 having several steel plates 9 attached to it at the face facing the slot 3 top face. In this way, the overall non-planar shape of collector bar 2 can be accomplished without the need to provide a non-planar collector bar 2 as one single piece.

The width of the steel plates 9 is similar to that of the collector bar 2. The thickness of the steel plates 9 may be chosen according to configuration as well as manufacturing considerations. The length of the steel plates 9 decreases stepwise according to design as well as manufacturing considerations. The edges of the steel plates 9 may be rounded or slanted.

At least one such steel plate 9 is attached to the collector bar 2.

The steel plates 9 are fixed to the collector bar 2 as well as to each other by welding, gluing, nuts and bolts or any other commonly known method.

In order to accomplish for the thermal expansion of the steel collector bar as well as steel plates and to ensure proper electrical contact, it is a preferred embodiment of this invention to place resilient graphite foil between the individual steel parts.

Instead of steel other metals may be used such as copper.

It is also within the scope of this invention to fix two short collector bars 2 symmetrically to a block of steel that is higher than the collector bars 2 and to use such an assembled collector bar 2 to manufacture a cathode 1 according to this invention.

Figure 7:
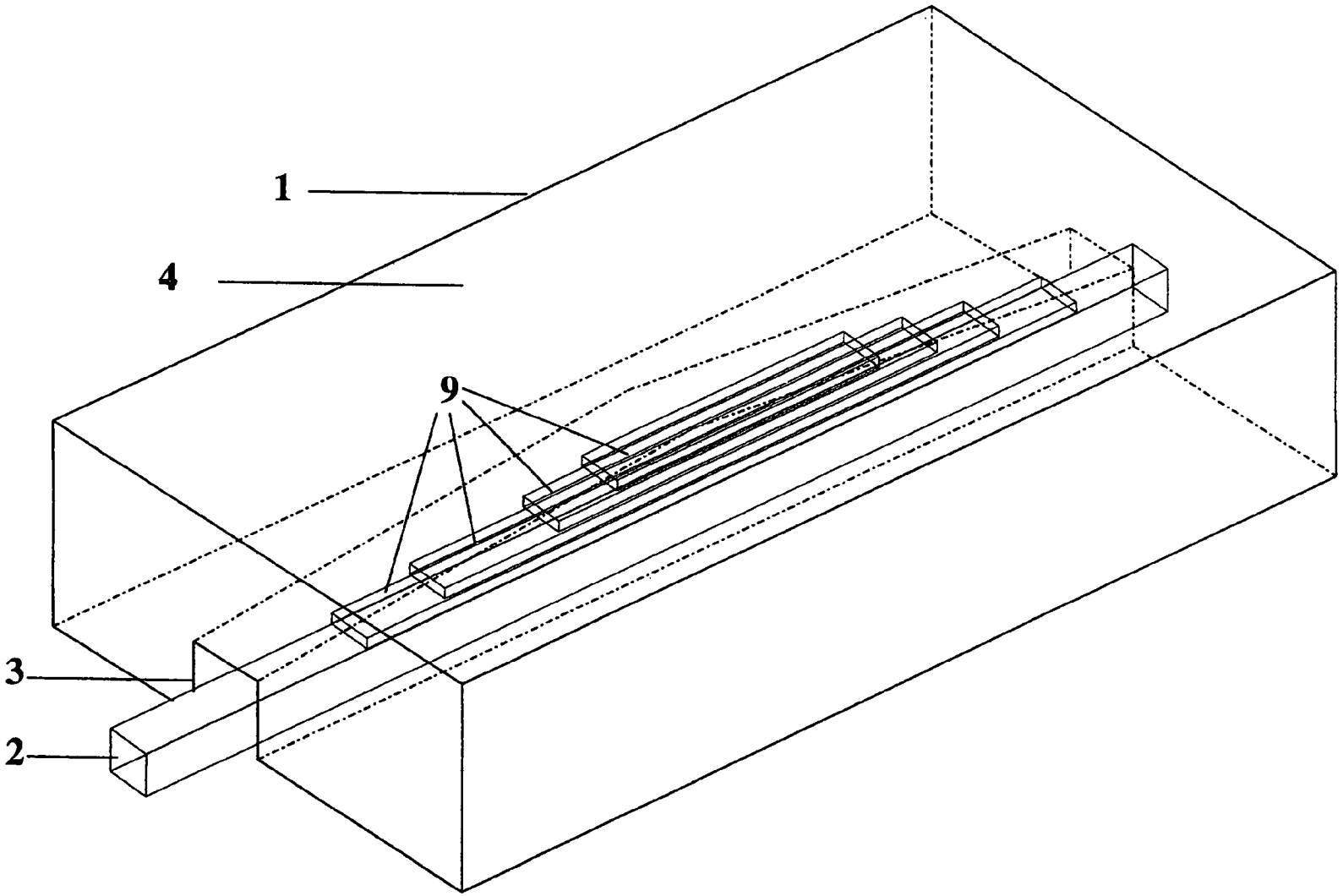
FIG. 7 is a diagrammatic, perspective view of an electrolytic cell for aluminum production with a cathode according to the invention showing the cathode current distribution.

FIG. 7 shows a schematic three-dimensional top view of the cathode 1 according to this invention, depicting the inventive cathode described in FIG. 6. In FIG. 6, the cast iron 5 is not shown for simplicity. FIG. 7 rather shows the setup of the cathode 1 before the cast iron 5 is poured into the collector bar slot 3. In this embodiment, the collector bar 2 is fitted with four steel plates 9, thus providing an overall almost triangular shape of collector bar 2.

Figure 8:
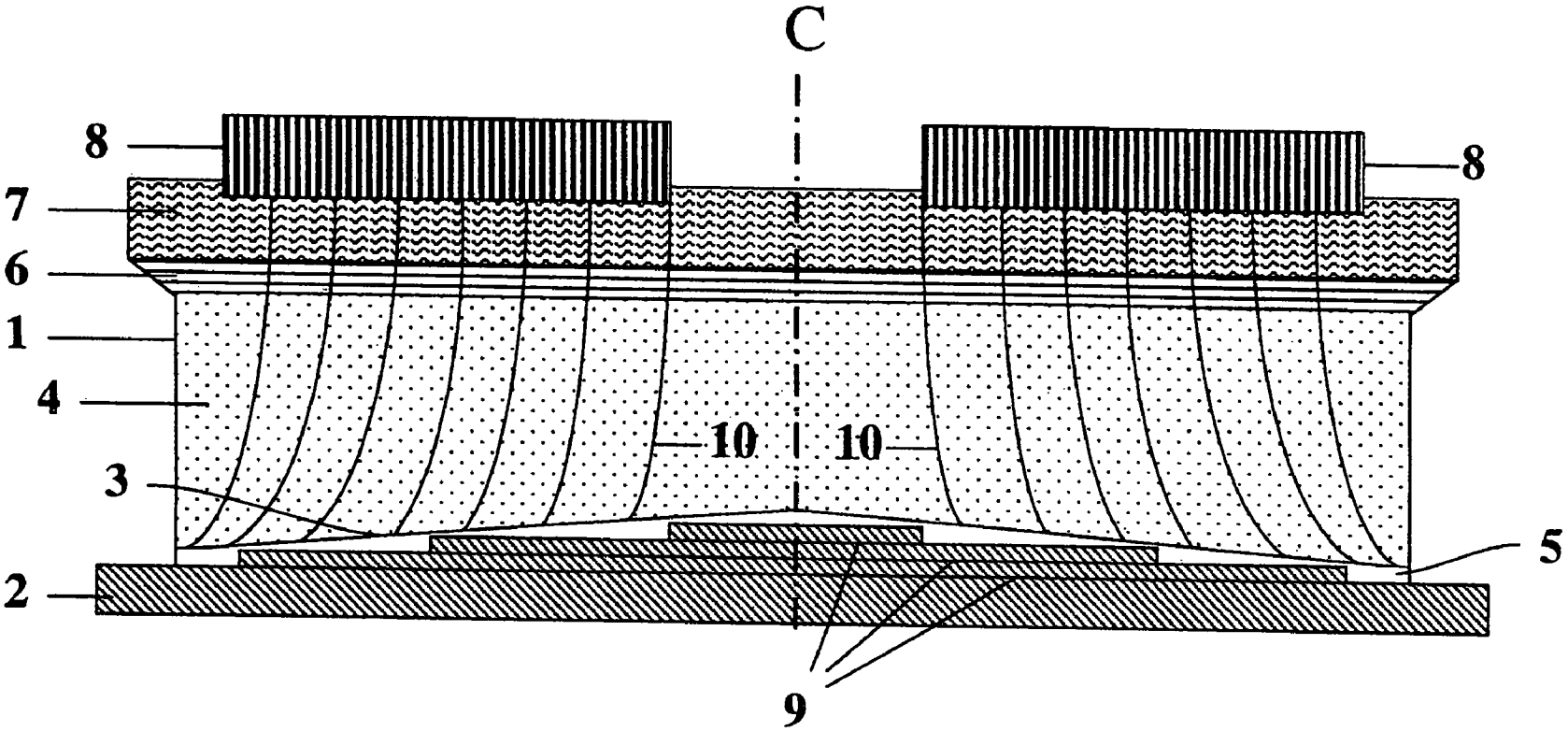
FIG. 8 is diagrammatic, three-dimensional top view of a cathode according to the invention.

FIG. 8 shows a schematic cross-sectional view of an electrolytic cell for aluminum production with a cathode 1 according to this invention, as shown in FIG. 6. In comparison to the prior art (FIG. 1), the cell current distribution lines 10 distributed more evenly across the length of the cathode 1 due to the inventive shape of collector bar slot 3 and collector bar 2.

Although the drawings show cathode blocks 4, or parts thereof, having a single collector bar slot 3, the invention applies to cathode blocks 4 with more than one collector bar slot 3 in the same manner.

Although the drawings shows cathodes 1 with single collector bars 2 in each collector bar slot 3, the invention applies to cathodes 1 with more than one collector bar 2 in each collector bar slot 3 in the same manner. Alternatively, two short collector bars 2 can be inserted into a collector bar slot 3 and joined at the cathode block 4 center C, both collector bars 2 having each at least one steel plate fixed to them at the end facing the other collector bar 2.

The invention is further described by following examples:

EXAMPLE 1

100 parts petrol coke with a grain size from 12 μm to 7 mm were mixed with 25 parts pitch at 150° C. in a blade mixer for 40 minutes. The resulting mass was extruded to a blocks of the dimensions 700×500×3400 mm (width×height×length). These so-called green blocks were placed in a ring furnace, covered by metallurgical coke and heated to 900° C. The resulting carbonized blocks were then heated to 2800° C. in a lengthwise graphitization furnace. Afterwards, the raw cathode blocks were trimmed to their final dimensions of 650×450×3270 mm (width×height×length). Two collector bar slots of 135 mm width and a depth increasing from 165 mm depth at the lateral edges to 200 mm depth at the block center were cut out from each block.

Afterwards, conventional steel collector bars were fitted into the slots. Electrical connection was made in the conventional way by pouring liquid cast iron into the gap between collector bars and block. The cathodes were placed into an aluminum electrolysis cell. The resulting current density distribution was compared with that of prior art cathodes and proved to be more homogeneous.

EXAMPLE 2

Cathode blocks trimmed to their final dimensions were manufactured according to example 1. Two collector bar slots of 135 mm width and a depth increasing from 165 mm depth at the lateral edges to 200 mm depth at the block center were cut out from each block.

Two steel collector bars according to the invention were manufactured by welding a single steel plate of 115 mm width, 40 mm thickness and 800 mm length centrically to a steel collector bar of the 115 mm width and 155 mm height at their center at the face eventually facing the slot top face.

The manufactured two steel collector bars were fitted into the slots. Electrical connection was made in the conventional way by pouring liquid cast iron into the gap between collector bars and block. The cathodes were placed into an aluminum electrolysis cell. The resulting current density distribution was compared with that of prior art cathodes and proved to be more homogeneous.

Having thus described the presently preferred embodiments of our invention, it is to be understood that the invention may be otherwise embodied without departing from the spirit and scope of the following claims.

The invention claimed is:

1. A cathode for aluminum electrolysis cells, comprising:

at least one steel-made current collector bar; and a cathode block selected from the group consisting of a carbon cathode block and a graphite cathode block, said cathode block having a collector bar slot formed therein and receiving said steel-made current collector bar, said collector bar slot having a depth higher at a center in longitudinal direction of said collector bar slot than at both lateral edges of said cathode block.

2. The cathode according to claim 1, wherein said collector bar slot has a shape selected from the group consisting of a triangular shape, a semi-circular shape and a semi-ellipsoidal shape.

3. The cathode according to claim 1, wherein said collector bar slot has at least one step.

4. The cathode according to claim 1, wherein said collector bar slot has an initial planar top face at both said lateral edges stretching over 10 to 1,000 mm from each edge.

5. The cathode according to claim 1, wherein said steel-made current collector bar has a thickness being higher at a center than at both said lateral edges of said cathode block.

6. The cathode according to claim 5, wherein said steel-made current collector bar has a thickness increasing exclusively at a face facing a top face of said collector bar slot.

7. The cathode according to claim 5, wherein said steel-made current collector bar has a shape selected from the group consisting of a triangular shape, a semi-circular shape and a semi-ellipsoidal shape.

8. The cathode according to claim 5, wherein said steel-made current collector bar has a thickness increasing by at least one step.

9. The cathode according to claim 5, further comprising at least one steel plate attached to said steel-made current collector bar.

10. The cathode according to claim 9, further comprising a resilient graphite foil disposed between said at least one steel plate and said steel-made collector bar.

11. The cathode according to claim 1, wherein said collector bar slot is one of a plurality of collector bar slots and said steel-made current collector bar is one of a plurality of current collector bars each disposed in one of said collector bar slots.

12. The cathode according to claim 1, further comprising:

steel plates disposed adjacent to said steel-made current collector bar; and resilient graphite foils each disposed between said steel plates or said steel-made collector bar and one of said steel plates.

13. A method of manufacturing cathodes for aluminum electrolysis cells, which comprises the steps of:

manufacturing a cathode block with standard external dimensions and selected from the group consisting of carbon cathode blocks and graphite cathode blocks;

machining in the cathode block at least one collector bar slot with an increasing depth towards a cathode block center in longitudinal direction of the at least one collector bar slot; and fitting at least one steel collector bar into the at least one collector bar slot.

14. A method of manufacturing cathodes for aluminum electrolysis cells, which comprises the steps of:

manufacturing a cathode block with standard external dimensions and selected from the group consisting of carbon cathode blocks and graphite cathode blocks;

machining in the cathode block at least one collector bar slot with an increasing depth towards a cathode block center in longitudinal direction of the at least one collector bar slot; and fitting at least one steel collector bar, with an increasing thickness at a face facing a top face of the collector bar slot towards the cathode block center, into the at least one collector bar slot.

15. An aluminum electrolysis cell, comprising:

a cathode containing:

at least one steel-made current collector bar; and a cathode block selected from the group consisting of a carbon cathode block and a graphite cathode block, said cathode block having a collector bar slot formed therein and receiving said steel-made current collector bar, said collector bar slot having a depth higher at a center in longitudinal direction of said collector bar slot than at both lateral edges of said cathode block.

* * * * *